US010941607B2

(12) United States Patent
Grobelny

(10) Patent No.: US 10,941,607 B2
(45) Date of Patent: Mar. 9, 2021

(54) WINDOW INSTALLATION APPARATUS

(71) Applicant: Wlodzimierz Grobelny, Przezmierowo (PL)

(72) Inventor: Wlodzimierz Grobelny, Przezmierowo (PL)

( * ) Notice: Subject to any disclaimer, the term of this patent is extended or adjusted under 35 U.S.C. 154(b) by 0 days.

(21) Appl. No.: 16/098,825

(22) PCT Filed: Mar. 10, 2017

(86) PCT No.: PCT/PL2017/000025
§ 371 (c)(1),
(2) Date: Nov. 2, 2018

(87) PCT Pub. No.: WO2017/192056
PCT Pub. Date: Nov. 9, 2017

(65) Prior Publication Data

US 2019/0136606 A1 May 9, 2019

(30) Foreign Application Priority Data

May 2, 2016 (PL) ..... 417068

(51) Int. Cl.
*E06B 1/60* (2006.01)
*E04F 21/00* (2006.01)

(52) U.S. Cl.
CPC ..... *E06B 1/6069* (2013.01); *E04F 21/0015* (2013.01); *E06B 1/6076* (2013.01)

(58) Field of Classification Search
CPC .... E06B 1/6015; E06B 1/6023; E06B 1/6053; E06B 1/6061; E06B 1/6069; E06B 1/6076; E06B 1/56; E06B 1/62; E06B 2001/622; E04F 21/0015; B25B 1/08; B25B 5/08
USPC ..... 52/204.65, 204.64, 204.68; 269/138, 234
See application file for complete search history.

(56) References Cited

U.S. PATENT DOCUMENTS 813,690 A * 2/1906 Corbin ..... E06B 1/6076 411/180
2,524,961 A * 10/1950 Cramer, Jr. ..... F01B 17/04 254/104
3,869,839 A * 3/1975 Johnson ..... E06B 1/6069 52/204.69

(Continued)

FOREIGN PATENT DOCUMENTS

DE 5 3392 1/1967
DE 195 26 203 A1 12/1995

(Continued)

*Primary Examiner* — Kyle J. Walraed-Sullivan
(74) *Attorney, Agent, or Firm* — Horst M. Kasper, Esq.

(57) ABSTRACT

The herein described invention is a window installation apparatus comprising of at least one wedge-shaped distance piece. The apparatus according to the invention comprises a body (1) connected in a sliding manner to a clamp (3) between which an expansion unit is positioned, comprising at least one wedge (6) and a lead screw (9) connected by means of a threaded connection with an opening (12) of the wedge (6), wherein the body (1) has protrusions (2) positioned at its opposite sides, lateral rails (5) mating with brackets (4) of the clamp (3) and an opening (10) in a rest wall (11) for the lead screw (9), while the outer walls (7) of the wedge (6) and the inner walls (8) of the body (1) and the clamp (3) converge downward at the same angle.

5 Claims, 5 Drawing Sheets

(56) References Cited

Figure 1:
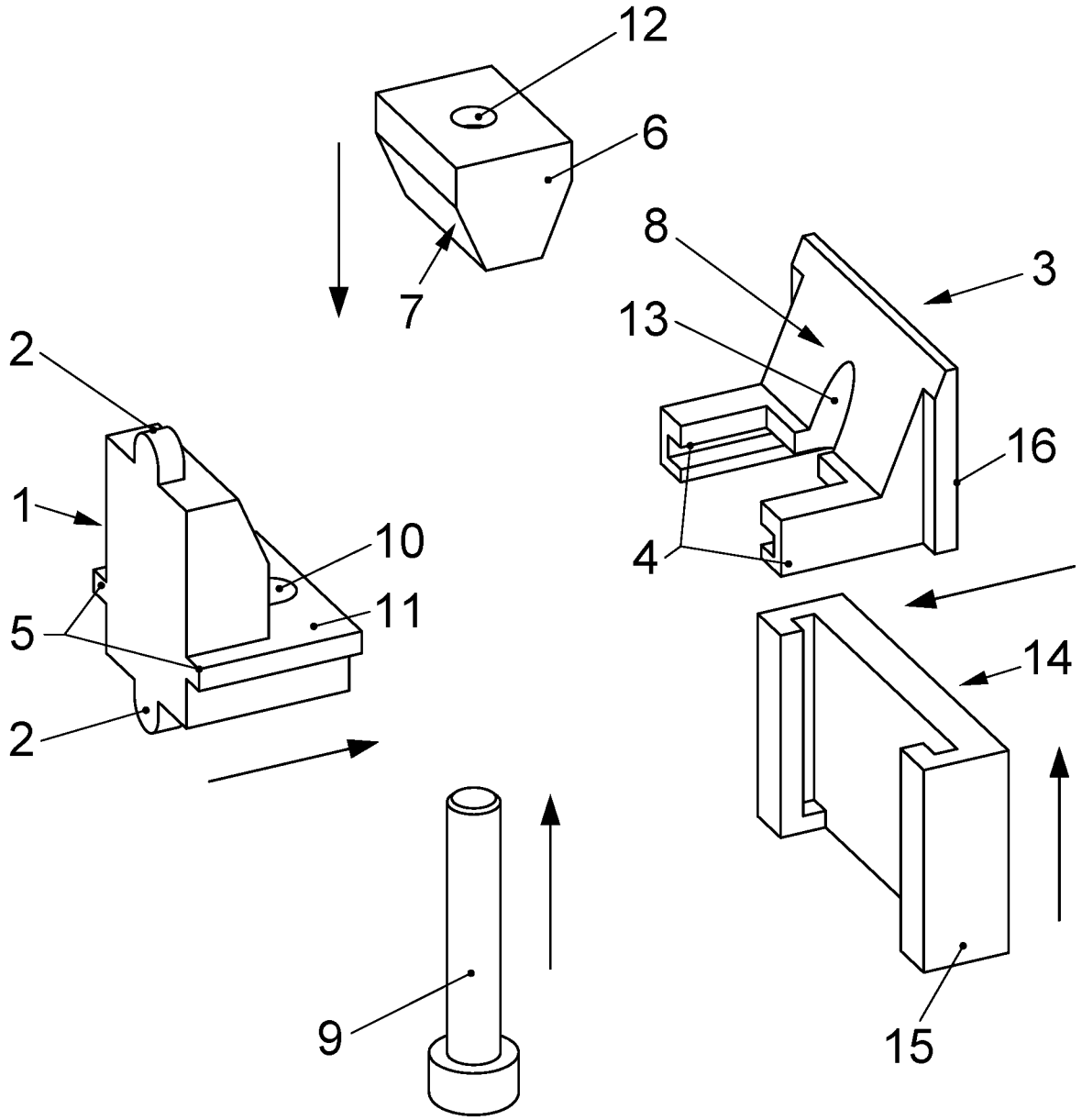

U.S. PATENT DOCUMENTS 4,713,922 A * 12/1987 Ingold ..... E06B 1/6069 254/104
4,804,171 A * 2/1989 Dornfeld ..... B25B 1/08 269/138
4,858,865 A * 8/1989 Schrepfer ..... F16M 7/00 248/188.2
4,930,959 A * 6/1990 Jagelid ..... E06B 1/6076 411/107
H906 H * 4/1991 Baggett ..... 254/104
5,427,349 A * 6/1995 Obrecht ..... B21D 28/00 248/188.4
5,577,355 A * 11/1996 Leonelli ..... E06B 3/5892 52/204.591
5,655,342 A * 8/1997 Guillemet ..... E06B 1/60 49/505
5,775,036 A * 7/1998 Stanley, Sr. ..... E04F 21/0015 248/354.4
6,018,916 A * 2/2000 Henry ..... E06B 1/6069 254/104
6,126,159 A * 10/2000 Dornfeld ..... B25B 5/08 269/138
6,318,037 B1 * 11/2001 Hansen ..... E06B 1/30 52/204.54
6,341,427 B1 * 1/2002 Tepley ..... B27F 7/00 33/194
6,546,682 B1 * 4/2003 DeBlock ..... B32B 17/10 52/204.68
7,240,435 B1 * 7/2007 Dowdakin ..... A47G 27/0487 33/194
7,240,436 B1 * 7/2007 Miller ..... E04F 21/0015 33/194
8,359,796 B1 * 1/2013 Plummer ..... E06B 3/5892 52/204.61
8,621,793 B2 * 1/2014 Abdul Lathief ..... E06B 3/5821 52/204.53
8,720,073 B1 * 5/2014 Gordon ..... E04F 21/0015 33/194
8,813,437 B1 * 8/2014 Spofford ..... E06B 1/6069 52/126.1
8,925,258 B1 * 1/2015 Header ..... E05D 15/00 16/90
9,540,861 B2 * 1/2017 Abdul Lathief ..... E06B 3/549
9,683,402 B2 * 6/2017 Abdul Lathief .... E06B 3/66304
9,895,792 B2 * 2/2018 Chen ..... B25B 1/08
10,012,018 B1 * 7/2018 Plummer ..... E06B 3/5892
2002/0146539 A1 * 10/2002 Dwinell ..... E06B 1/6069 428/156
2003/0197319 A1 * 10/2003 Ho ..... B25B 1/08 269/246
2008/0075556 A1 * 3/2008 Smith ..... E06B 1/6076 411/379
2010/0264269 A1 * 10/2010 Stoob ..... B64D 11/04 244/118.5
2012/0198771 A1 * 8/2012 Weiss ..... E06B 3/4415 49/70
2014/0093691 A1 * 4/2014 Shray ..... B29C 44/583 428/156
2015/0159421 A1 * 6/2015 Eck ..... E06B 3/26 52/204.591
2017/0314906 A1 * 11/2017 Beer ..... E06B 1/6069

FOREIGN PATENT DOCUMENTS

DE 10 2007 006 087 A1 8/2008
EP 3 170 959 A1 5/2017
GB 2 413 352 B 11/2009
PL 107 340 U1 5/1998
PL 395 188 A1 12/2012
PL 414 832 A1 5/2017
WO WO 00/39425 7/2000
WO WO 2005/068 749 A1 7/2005
WO WO 2005/102609 A1 11/2005
WO WO 2009/070081 A1 6/2009
WO WO 2015/066743 A1 5/2015

* cited by examiner

Prior Art

WINDOW INSTALLATION APPARATUS

The herein described invention is an apparatus for window installation in the window opening.

The most common method of window installation in the window opening is known for years and consists in securing the frame by positioning it parallel to the wall, at a certain distance from its surface, simultaneously ensuring that the window is aligned vertically and horizontally. This method requires the installer to use a set of wooden wedges for preliminarily securing the frame. The wedges are delicately driven between the frame and the surface of the window opening. However, this method is problematic for a single installer, because it is not easy to perform with two hands only and thus requires a considerable amount of skills and experience. Namely, the installer must simultaneously hold the frame, insert a wooden wedge underneath it and drive it in with a hammer to secure it in place. As the wedge is being driven in, it secures the fame but simultaneously moves it relative to the outside surface of the wall. As a result, the procedure must be repeated several times and a spirit level must be used to ensure that the frame is vertically aligned. Consequently, window installation is often flawed in many ways, the most common issue being excessive clearance between the frame and the window opening.

Figure 8:
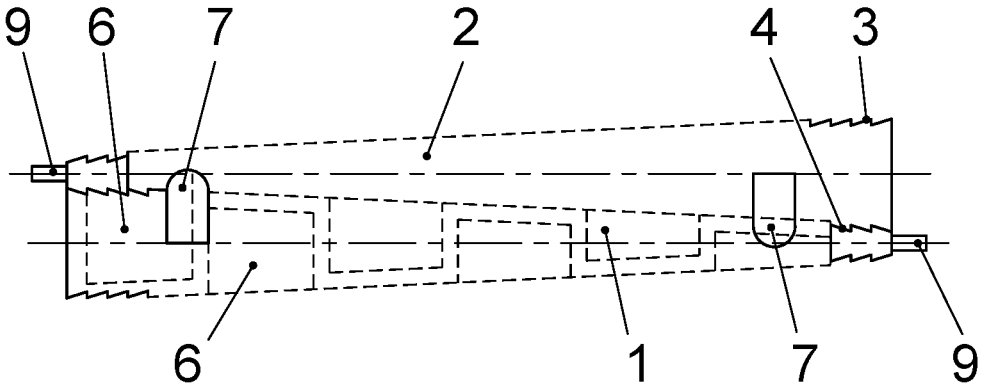
FIG.8 Prior Art

The description of the utility model PL.107340 (U1) teaches a set of installation wedges shown in drawing of FIG. 8, characterized in that both the upper (3) and the bottom (4) surface of each wedge (1, 2) has preformed transverse ridges, and both these surfaces have preformed transverse rectangular cavities (6) shaped symmetrically to one another, and each lateral surface (7) of each wedge has guide protrusions, extending beyond the outline.

Figure 9:
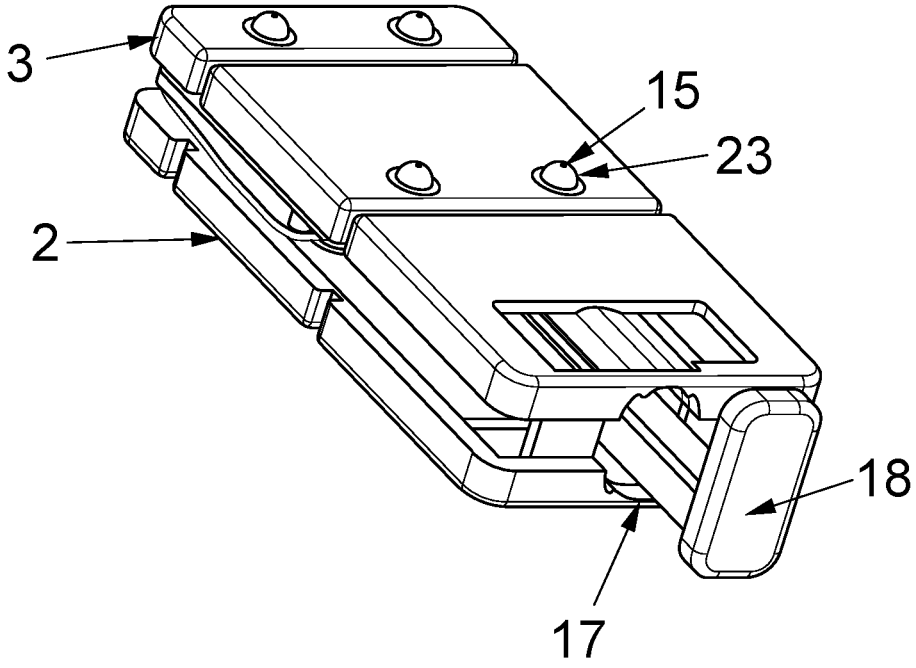

The international application WO2005068749 (A1) teaches a distance (expansion) piece that can replace a traditional wedge for fitting a window to an opening of a building, as shown in drawing FIG. 9. In this embodiment, the distance piece consists of two part (2, 3) having inner surfaces (4, 5) facing towards each other and outer surfaces (7, 8) forming outer parts of the distance piece. The outer surface comprises resilient protrusions (15) located in cavities of the surfaces (23).

Importantly, the parts (2, 3) are movable relative to each other and can expand forming a wedge, whose cross-section forms an isosceles triangle. The parts can also be contracted. They are separated by means of a separation part (9) comprising a lock (17) and an ergonomically shaped grip (18) provided with a non-slippery surface. During use, the separation part (9) is inserted between the two parts (2, 3) which are apart. The separation part (9) is adapted to move linearly in the inner space to effect the movement of the set of first contact portions (10, 11), and those portions expand the parts (2 and 3). In addition, the parts (2, 3) are flexibly connected by means of a resilient connecting element, preferably taking the form of rubber bands. The two circumferentially extending grooves (21) serve to fixate two of such rubber bands in place.

All parts of the distance piece can be made of wood or steel or made of a polymeric or ceramic material, a composite material comprising fibres of glass, carbon or Kevlar (polymer material).

Figure 11:
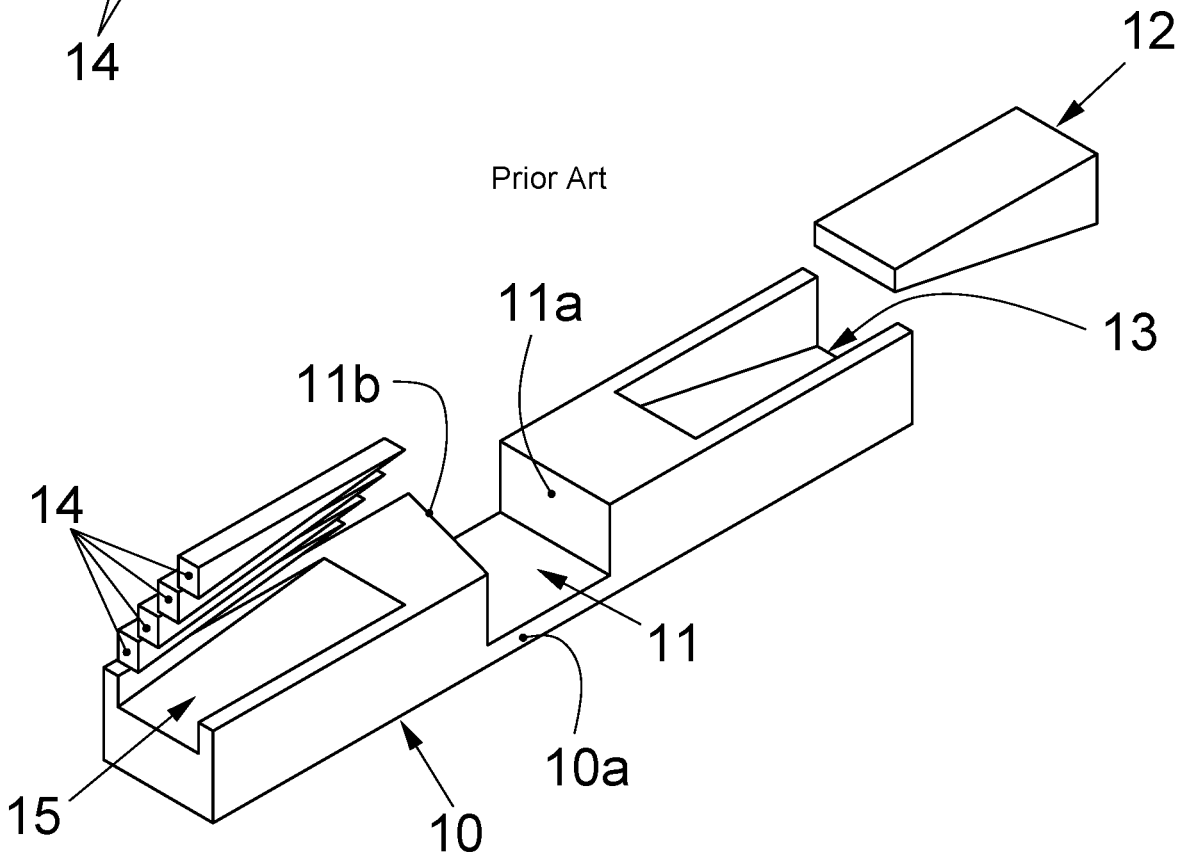

The description of the international application WO2005102609 (A1) (also published as GB2413352 (B)) teaches a door support and alignment kit, as shown in drawing of FIG. 11. The kit comprises an elongated block (10) having a transverse slot (11) formed with two recesses (13, 15). Recess (13) receives a single wedge (12) while recess (15) can receive secondary wedges (14) positioned side-by-side.

A door (D) can be stood on its edge and engaged in the transverse slot (11) and rested on the upper surface of web (10A). Wedge (12) is slid into the transverse slot (11) alongside one face of the door (D), to wedge the door against end surface (11*b*), and hold the door vertically. Once the door has been planed to size, and positioned within the door frame, smaller wedges (14) can be inserted into the gaps between the edges of the door (D) and frame, to align the door within the inner frame.

The purpose of the present invention was to develop an apparatus for window installation that makes window installation significantly easier not only to a skilled installer but also to an inexperienced person lacking the necessary skills.

In accordance with the present invention, the window installation apparatus comprising of at least one wedge-shaped distance piece has a body connected in a sliding manner to a clamp. Between the body and the clamp, an expansion unit is positioned, comprising a wedge and a lead screw connected by means of a threaded connection to an opening in the wedge. The body has protrusions positioned at its opposite sides, lateral rails mating with the clamp's brackets and an opening in a rest wall for the lead screw. The outer surfaces of the wedge and the inner surfaces of the body and the clamp converge downward at the same angle. The inclination of the walls of the body and the clamp and the walls of the wedge is 10÷50 degrees, and preferably 30 degrees.

The opening in the rest wall for the lead screw is preferably elongated oval in shape.

Inner walls of the body and the clamp comprise vertical recesses to accommodate the screw.

Additionally, the apparatus comprises a cover connected in a sliding manner to the clamp, intended for extending the working range of the apparatus.

The device according to the present invention offers a simple solution that makes window installation significantly easier. The device is reliable and easy to operate. The use of three (and preferably four) such devices makes it possible to fit a window in the window opening in a short time, even by one person only.

Figure 2:
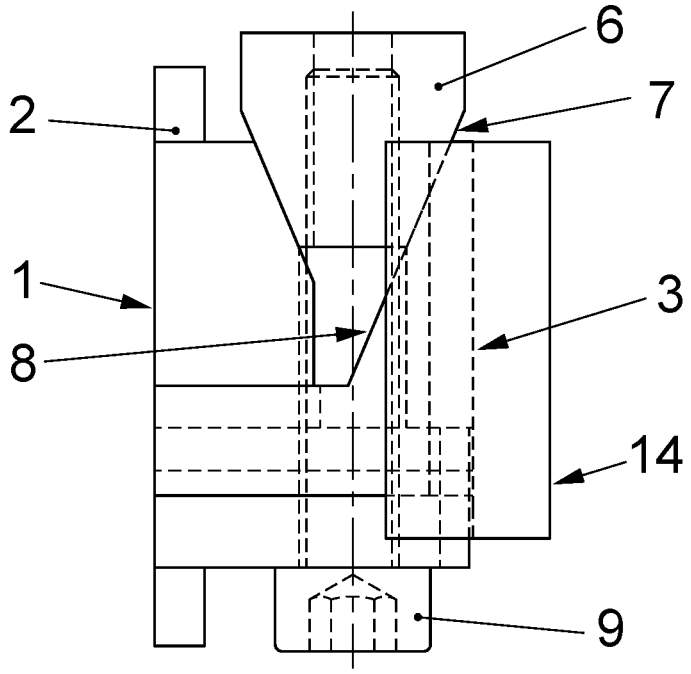
Figure 3:
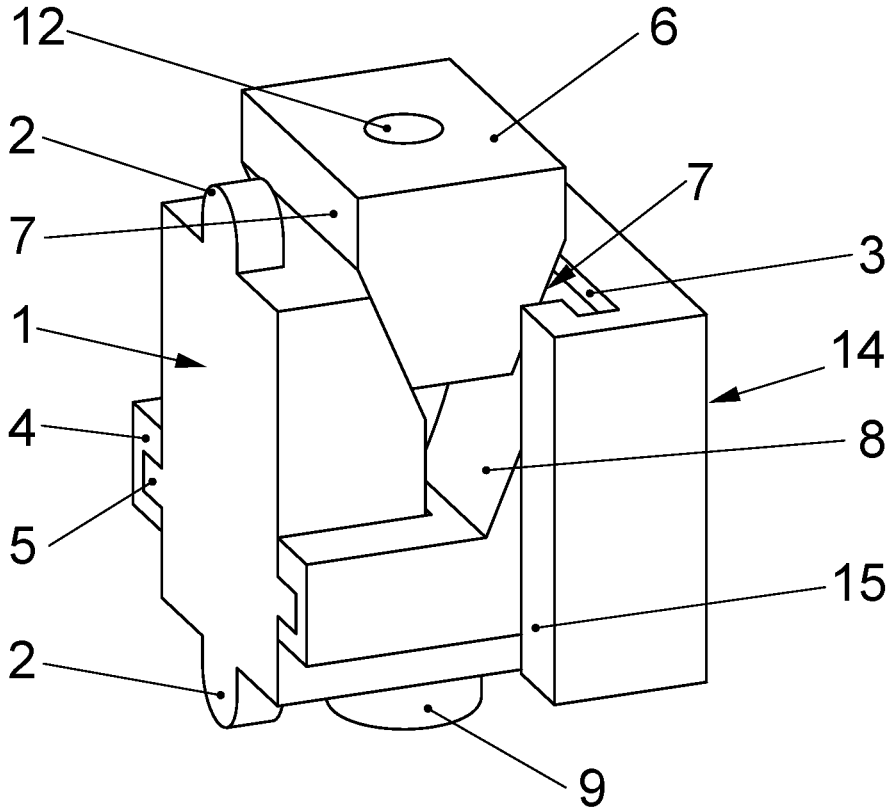
Figure 4:
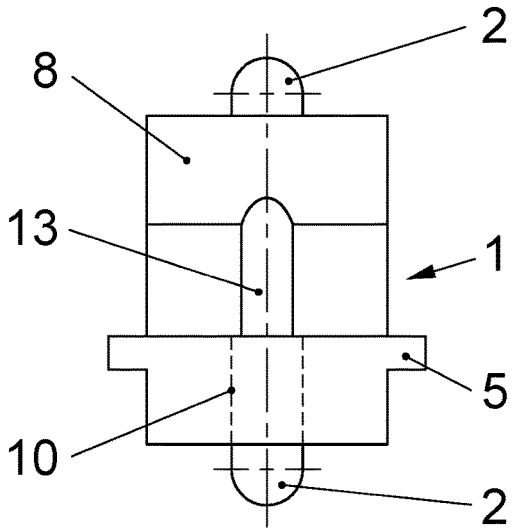
Figure 5:
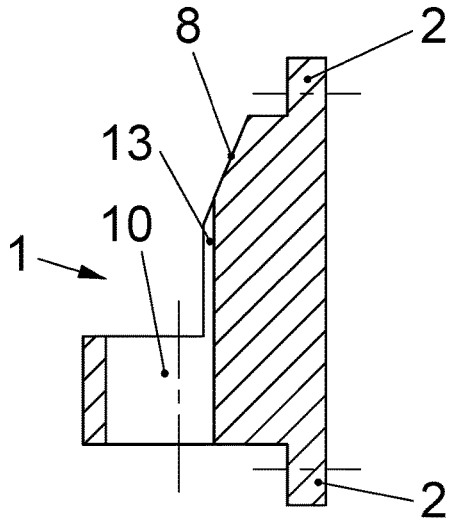
Figure 6:
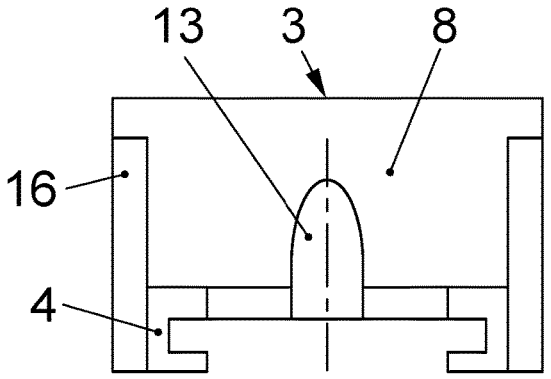
Figure 7:
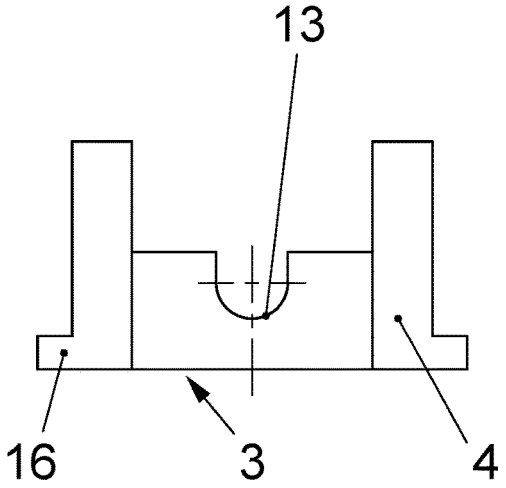
Figure 10:
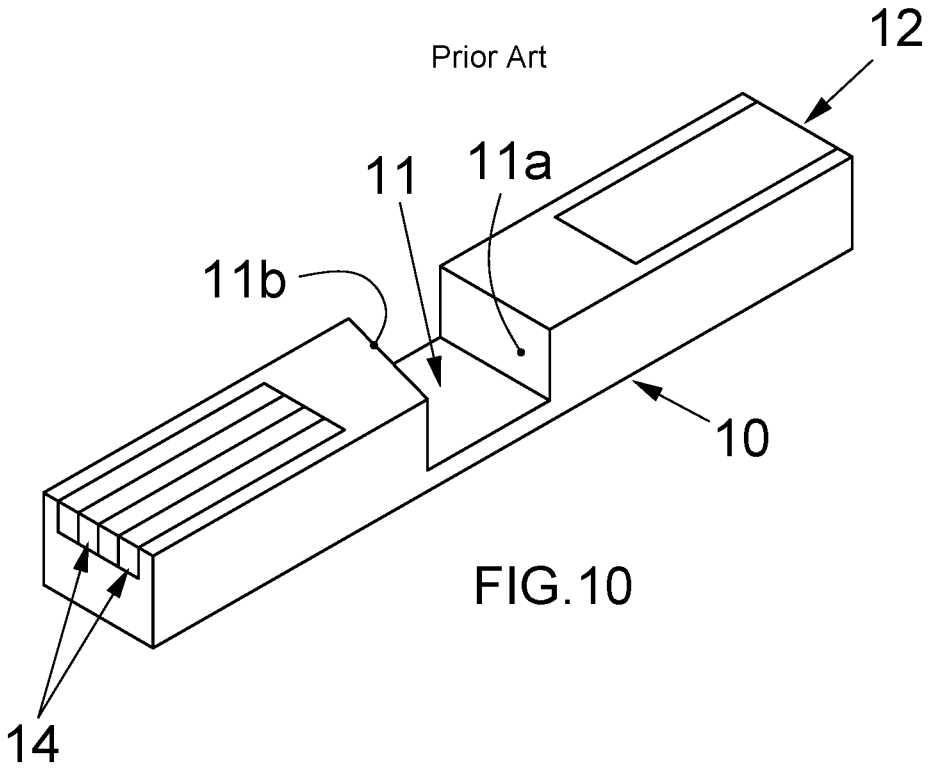

The subject of the invention is presented in two embodiments in a schematic drawing, where:

FIG. 1 shows an exploded view of the window installation apparatus in its first embodiment (perspective view), FIG. 2 shows a window installation apparatus in its first embodiment (front view), FIG. 3 shows the same apparatus (perspective view), FIG. 4 shows a body of the apparatus (front view, as seen from the clamp), FIG. 5 shows axial section of the body, FIG. 6 shows the clamp (front view, as seen from the body), FIG. 7 shows the clamp (bottom view), FIG. 8 shows a set of installation wedges (prior art), FIG. 9 shows a distance (expansion) piece (prior art), FIG. 10 shows a perspective view of an alignment kit (prior art), and FIG. 11 shows an exploded view of an alignment kit (prior art).

The window installation apparatus according to the invention has been used for the installation of a PVC window. Four such devices were used.

Each device was made of a plastic material technically known as POM (polyacetal), considered to be one of the most rigid and robust thermoplastics.

The window installation apparatus comprises a body 1 intended for quick installation outside a PVC window frame (not shown in the drawing) near its corners by means of protrusions 2 extending from the body 1. The protrusions 2, positioned on opposite sides of the body 1, lock in a rail (not shown in the drawing) positioned outside the window frame. The body 1 interacts with a clamp 3, connected in a sliding manner to the body 1 by means of brackets 4 of the clamp 3 and the rail 5 formed out of the sides of the body 1. Furthermore, the apparatus comprises an expansion unit consisting of a wedge 6 positioned between the body 1 and the clamp 3.

Outer walls 7 of the wedge 6 converge downwards at an angle of 30 degrees. Likewise, inner walls 8 of the body 1 and the movable clamp 3 (facing the wedge 6) incline at an angle of 30 degrees. Furthermore, the apparatus comprises a steel lead screw 9.

The lead screw 9 is positioned in the body 1, in an oval opening 10 made in a rest wall 11, against which its head rests from the bottom. The other end of the lead screw 9 is threaded into an opening 12 in the wedge 6.

Inner walls 8 of the body 1 and the clamp 3 comprise vertical recesses 13 to accommodate the screw 9.

Driving the lead screw 9 into the wedge 6 pulls the wedge 6 towards the body 1, as a result of which the walls 7 of the wedge 6 press against the inner walls 8 of the body 1 and the clamp 3. The interaction of the inclined elements 7 and 8 of the apparatus pushes the clamp 3 outwards, thus expanding the apparatus.

In the case of one of the four devices used according to the invention, the installer found that the expansion range was insufficient because the gap between the window and the wall was too wide. Therefore, he used an additional element in the form of a cover 14 for the clamp 3. The two elements are connected in a sliding manner by means of brackets 15 of the cover that mate with side rails 16 of the clamp 3.

By using the devices according to the invention a single operator easily fitted and immobilized the window frame in a correct position in the window opening before its final installation by means of expanding foam.

LIST OF REFERENCE

1—body
2—protrusion of the body
3—clamp
4—clamp bracket
5—rail
6—wedge
7—outer wall of the wedge
8—inner wall of the body and the clamp
9—lead screw
10—rest wall opening
11—rest wall
12—wedge opening
13—recess
14—cover
15—cover bracket
16—side rail

The invention claimed is:

1. A window installation apparatus comprising
a body (1), a clamp (3) and an expansion unit positioned between the body (1) and the clamp (3),
wherein the expansion unit comprises a wedge (6) and a lead screw (9),
wherein the clamp (3) comprises brackets (4),
wherein the body (1) comprises lateral rails (5) and an opening (10) in a rest wall (11) against which a head of the lead screw (9) rests,
wherein outer walls (7) of the wedge (6) and inner walls (8) of the body and the clamp (3) converge downward at a same angle,
wherein the lead screw (9) is configured to drive into the wedge (6) to press the wedge (6) against the inner walls (8) of the body (1) and the clamp (3) thereby expanding the window installation apparatus,
wherein the body (1) is slidably connected to the clamp (3),
wherein the brackets (4) of the clamp (3) are disposed on the lateral rails of the body (1), and wherein the brackets (4) of the clamp (3) are configured to slide on the lateral rails (5),
wherein the lead screw (9) is threadably connected to an opening (12) of the wedge (6), and
wherein the body (1) has protrusions (2) positioned on opposite sides of the body (1) protruding in opposite directions, wherein the protrusions (2) lock the body (1) in a rail positioned outside of a window frame.

2. The window installation apparatus according to the claim 1, wherein an inclination angle of the inner walls (8) of the body (1) and the clamp (3) and the outer walls (7) of the wedge (6) is 10 to 50 degrees.

3. The window installation apparatus according to the claim 1, wherein the opening (10) in the rest wall (11) accommodating the lead screw (9) is elongated oval in shape.

4. The window installation apparatus according to the claim 1, wherein the inner walls (8) of the body (1) and the clamp (3) comprise vertical recesses (13) to accommodate the lead screw (9).

5. The window installation apparatus according to the claim 1, further comprising a cover (14) slidably connected to the clamp (3) such that the cover (14) is configured to slide with respect to clamp (3).

* * * * *